US006883535B1

(12) United States Patent
Cromwell et al.

(10) Patent No.: US 6,883,535 B1
(45) Date of Patent: Apr. 26, 2005

(54) LIQUID HANDLING APPARATUS

(75) Inventors: Samuel H. Cromwell, Honeoye Falls, NY (US); Alan F. Tucker, Hilton, NY (US); Gary S. Hartman, Spencerport, NY (US)

(73) Assignee: Unified Solutions Inc., Rochester, NY (US)

( * ) Notice: Subject to any disclaimer, the term of this patent is extended or adjusted under 35 U.S.C. 154(b) by 120 days.

(21) Appl. No.: 10/172,148

(22) Filed: Jun. 14, 2002

Related U.S. Application Data

(63) Continuation-in-part of application No. 09/827,553, filed on Apr. 6, 2001, now abandoned.

(60) Provisional application No. 60/298,311, filed on Jun. 14, 2001, and provisional application No. 60/205,445, filed on May 19, 2000.

(51) Int. Cl.[7] ..... F04F 1/06

(52) U.S. Cl. ..... 137/148; 137/152; 417/148

(58) Field of Search ..... 137/142, 145, 137/148, 152, 153; 417/148

(56) References Cited

U.S. PATENT DOCUMENTS

| | | | | |
|---|---|---|---|---|
| 104,641 A | | 6/1870 | Pitman | |
| 108,087 A | | 10/1870 | Averell | |
| 136,264 A | | 2/1873 | Randall | |
| 222,300 A | | 12/1879 | Neuman | |
| 361,691 A | | 4/1887 | Goodrich | |
| 383,153 A | | 5/1888 | Siersdorfer | |
| 503,232 A | | 8/1893 | Franklin | |
| 643,605 A | | 2/1900 | Pendergraft | |
| 806,095 A | | 12/1905 | Barrow | |
| 892,254 A | | 6/1908 | Hanson | |
| 895,694 A | | 8/1908 | Silverberg | |
| 927,360 A | * | 7/1909 | Kolvig | 137/152 |
| 1,308,101 A | | 7/1919 | Oftedahl | |

(Continued)

*Primary Examiner*—Gerald A. Michalsky
(74) *Attorney, Agent, or Firm*—Basch & Nickerson LLP; Duane C. Basch

(57) ABSTRACT

The present invention is an apparatus for the transfer of fluid or fuel, from a reservoir to a container, which may be a tank from which the liquid will be used or a tank in which the liquid will be temporarily stored. The apparatus includes a compliant base element, preferably having a tapered outer diameter and two holes therethrough. The first hole is adapted to sealingly receive one end of a length of tubing whereas the second hole is adapted to receive the intake end of a hand-operated vacuum pump. Upon insertion of the opposite end of the length of tubing into a liquid-filled reservoir, and insertion into and sealing of the compliant base with a container or tank, the pump may be operated to negatively pressurize the tank or container and initiate the flow of liquid from the reservoir to the tank or container.

19 Claims, 5 Drawing Sheets

U.S. PATENT DOCUMENTS

| | | | | |
|---|---|---|---|---|
| 1,572,150 | A | | 2/1926 | Kiefer |
| 1,582,399 | A | | 4/1926 | Helander |
| 1,834,453 | A | | 12/1931 | Gavaza |
| 2,106,492 | A | | 1/1938 | Adams |
| 2,250,517 | A | | 7/1941 | Zolleis |
| 2,317,589 | A | | 4/1943 | Collinson |
| 2,405,489 | A | | 8/1946 | Brock |
| 2,434,846 | A | | 1/1948 | Hagan |
| 2,479,058 | A | | 8/1949 | Botting |
| 2,483,740 | A | | 10/1949 | Routen |
| 2,538,115 | A | | 1/1951 | Maurer |
| 2,740,420 | A | | 4/1956 | Hanks |
| 3,062,056 | A | | 11/1962 | Wicoff |
| 3,124,149 | A | | 3/1964 | Pape |
| 3,280,858 | A | | 10/1966 | Paulson |
| 3,336,061 | A | | 8/1967 | Heisler |
| 3,384,132 | A | | 5/1968 | Lisciani |
| 3,449,958 | A | | 6/1969 | Bailey |
| 3,783,888 | A | | 1/1974 | Johnson |
| 3,973,751 | A | | 8/1976 | Brugnoli et al. |
| 4,301,826 | A | | 11/1981 | Beckerer |
| 4,378,026 | A | | 3/1983 | Bauer |
| 4,450,730 | A | | 5/1984 | Levos et al. |
| 4,475,410 | A | | 10/1984 | Jaeger |
| 4,548,088 | A | | 10/1985 | Hood |
| 4,930,360 | A | | 6/1990 | Tan |
| 4,997,003 | A | | 3/1991 | Brennan |
| 5,193,404 | A | | 3/1993 | Tan |
| 5,341,691 | A | | 8/1994 | Callis et al. |
| 5,476,372 | A | | 12/1995 | Yang |
| 5,617,891 | A | | 4/1997 | True |
| 5,785,085 | A | | 7/1998 | Halsnes et al. |
| 6,056,029 | A | | 5/2000 | Devall et al. |
| 6,112,759 | A | | 9/2000 | Hsu |
| 6,327,920 | B1 | | 12/2001 | Clark |
| 2001/0035208 | A1 | * | 11/2001 | Cromwell et al. ..... 137/205 |

* cited by examiner

LIQUID HANDLING APPARATUS

CROSS REFERENCE

Priority is claimed from the following U.S. patent applications, which are also hereby incorporated by reference for their teachings:

This application is a continuation-in-part of U.S. patent application Ser. No. 09/827,553 for a "LIQUID HANDLING APPARATUS AND CONTAINER," by Cromwell et al. filed Apr. 6, 2001, and now abandoned, which was based on Provisional Application No. 60/205,445, filed May 19, 2000; and Provisional Application No. 60/298,311 for a "LIQUID HANDLING APPARATUS," by Cromwell et al., filed Jun. 14, 2001.

This invention relates generally to a liquid handling apparatus, and more particularly to an improved and safer fuel pumping and siphoning apparatus that may be used with a wide range of containers.

BACKGROUND AND SUMMARY OF THE INVENTION

The present invention is directed to a liquid and fuel extracting apparatus for use with a variety of tanks and temporary storage containers having improved safety features and reduced manufacturing costs.

Heretofore, a number of patents and publications have disclosed fuel pumping systems and siphons, the relevant portions of which may be briefly summarized as follows:

U.S. Pat. Nos. 503,232, 892,254, 895,694 and 4,548,088 each depicts and describes a siphon/pump system where a tank may be filled. In particular, U.S. Pat. No. 4,548,088 teaches a flexible tube that extends from the receptacle to be sampled to the head of a collection jar, and a coupling mechanism 20 for removably attaching the flexible tube to the jar head.

U.S. Pat. No. 892,254 illustrates and describes a tank with a removable cover having a first opening adapted to connect to a flexible tube, and a second opening in air-tight communication with the suction chamber of a pump. A similar apparatus is described in U.S. Pat. Nos. 503,232 and 895, 694, both of which speak to a siphoning system that is initiated by a pump mechanism.

On the other hand, none of the various patents teach a liquid handling apparatus having a negatively pressurizing, linear displacement hand pump, or where the apparatus may be removably and sealingly attached to an opening on a wide range of tanks. Furthermore, each of the pump mechanisms disclosed are of conventional construction, and do not disclose the cost-saving features of the redesigned pump used in the present invention.

In accordance with the present invention, there is provided a liquid handling apparatus, comprising: a compliant base having a tapered outer diameter suitable for mating with an inner diameter of a container opening so as to form a generally airtight seal therewith, said compliant base further including a pair of through-holes; a length of tubing having a first end inserted through a first one of said through-holes in said compliant base, so as to form an air-tight connection between the tubing and the base; and a vacuum pump, said vacuum pump being releasably attachable at an upper end of a second one of said through-holes in an airtight manner, the pump being suitable for producing a negative pressure within the container the pump is operated by a user; wherein a second end of the tubing is inserted into a liquid reservoir and where operation of the pump by the user creates a negative pressure sufficient to draw the liquid from a liquid reservoir into the container.

In accordance with another aspect of the present invention, there is provided a liquid handling apparatus, comprising in series: a length of tubing having a first end and a second end; a compliant base having a tapered outer profile suitable for sealingly mating with a plurality of containers having different diameter openings therein, wherein the first end of the tubing is attached to a first opening in said compliant base, so as to form an air-tight connection between the first end of the tubing and the compliant base; and a vacuum operatively attached to a second opening in said compliant base in an airtight manner, the pump having a handle driving a plunger therein and being suitable for producing a vacuum within the container when the handle is operated by a user; wherein the second end of the tubing is inserted into a liquid reservoir having a liquid therein and where the vacuum draws the liquid from the liquid reservoir and into the container to initiate transfer of the liquid.

In accordance with yet another aspect of the present invention, there is provided a method of extracting liquid from a reservoir with a liquid handling apparatus, comprising the steps of: inserting a compliant base, having a tapered outer profile and a pair of through-holes therein, into an opening of a container; inserting, into a first of said through-holes, a first end of a length of tubing so as to form an air-tight connection between the first end of the tubing and the compliant base; inserting a second end of the length of tubing into a liquid-filled reservoir so that the second end is below a surface of the liquid; attaching a vacuum pump to the second through-hole in the compliant base in an airtight manner, the pump having a handle driving a plunger therein and being suitable for producing a vacuum within the container when the compliant base is inserted in the opening of the container and the handle is operated by a user; and repeatedly operating the handle on the vacuum pump to create a vacuum in the container and draw the liquid from the liquid-filled reservoir into the container to initiate transfer of the liquid from the reservoir to the container.

One aspect of the invention deals with a basic problem of storing fuel, and in siphoning fuels and other liquids—exposure to the fuel and storage thereof. This aspect is further based on the discovery of a technique that alleviates this problem. The technique uses a portable pumping apparatus and unique base for connecting to a tube to establish the vacuum necessary to initiate pumping or siphoning from a reservoir via a vacuum pump. In a pumping mode, the amount of liquid transferred is controlled by a user operating a manual pump that negatively pressurizes the receiving tank or container. In the siphoning mode, once siphoning is initiated, pumping may be stopped and the siphoning process may be used to fill the receiving tank to a desired level. After siphoning, the receiving tank is suitable for use as a filling tank to transfer the fuel or liquid, or as a temporary storage tank as contemplated by traditional gasoline and similar containers.

The technique described above is advantageous because it is enabled by a simple, low-cost apparatus as compared to other approaches. Furthermore, The present invention is uniquely designed to be adapted to one or more of a plurality of differently sized or shaped tank openings so as to enable its use both with conventional fuel storage tanks and equipment fuel tanks. Moreover, these approaches make it unnecessary to have large gasoline or fuel storage containers in one's possession or to risk the dangers of filling and transporting such containers in personal vehicles. The apparatus described herein can be adapted to siphon and pump any of a number of liquids or fuels, including gasoline, diesel fuel, motor oil, crankcase oil, hydraulic oils and other petroleum distillates and synthetic lubricants, water, chemicals, etc. As a particular result of the invention, there is little need for the storage of large quantities of gasoline or other fuels in a residence or in portable storage containers as the amount of fuel needed at any time may be easily retrieved from a vehicle and any excess may be returned to the vehicle.

Figure 1:
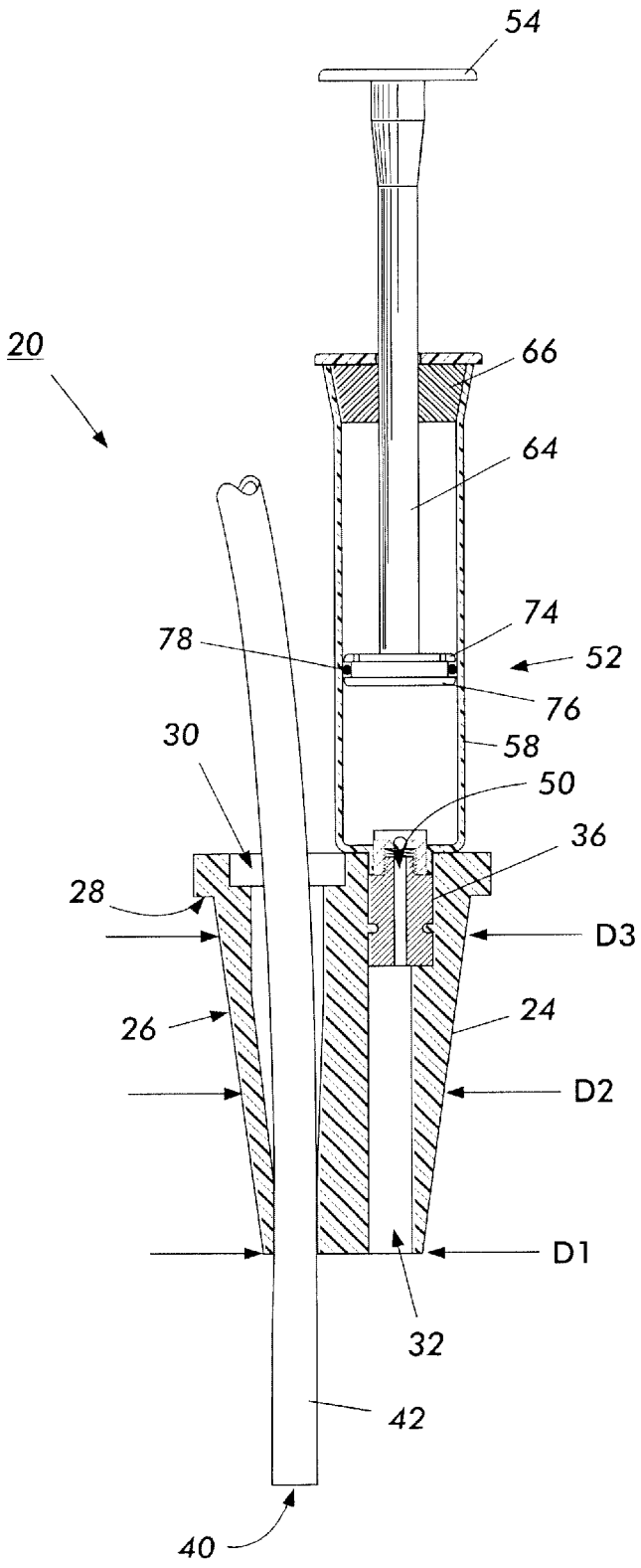
FIG. 1 is an orthogonal view of an embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description.

A "portable tank" is any liquid tight container used for the enclosed storage of a liquid therein. While size may be a factor in determining the portability of the tank, the present invention is not intended to be limited in any way by the size of the tank. An "equipment tank" is intended to represent any fuel or other liquid tank that is operatively associated with a piece of equipment, including but not limited to, lawn and garden maintenance equipment (e.g., lawn mowers, chain saws, string trimmers), construction equipment (e.g., compressors, generators, mixers), watercraft (e.g., jet skis, boats), off-road and personal recreational vehicles (e.g., all-terrain vehicles, snowmobiles) and on-road vehicles (e.g., cars, trucks, motorcycles).

Figure 2:
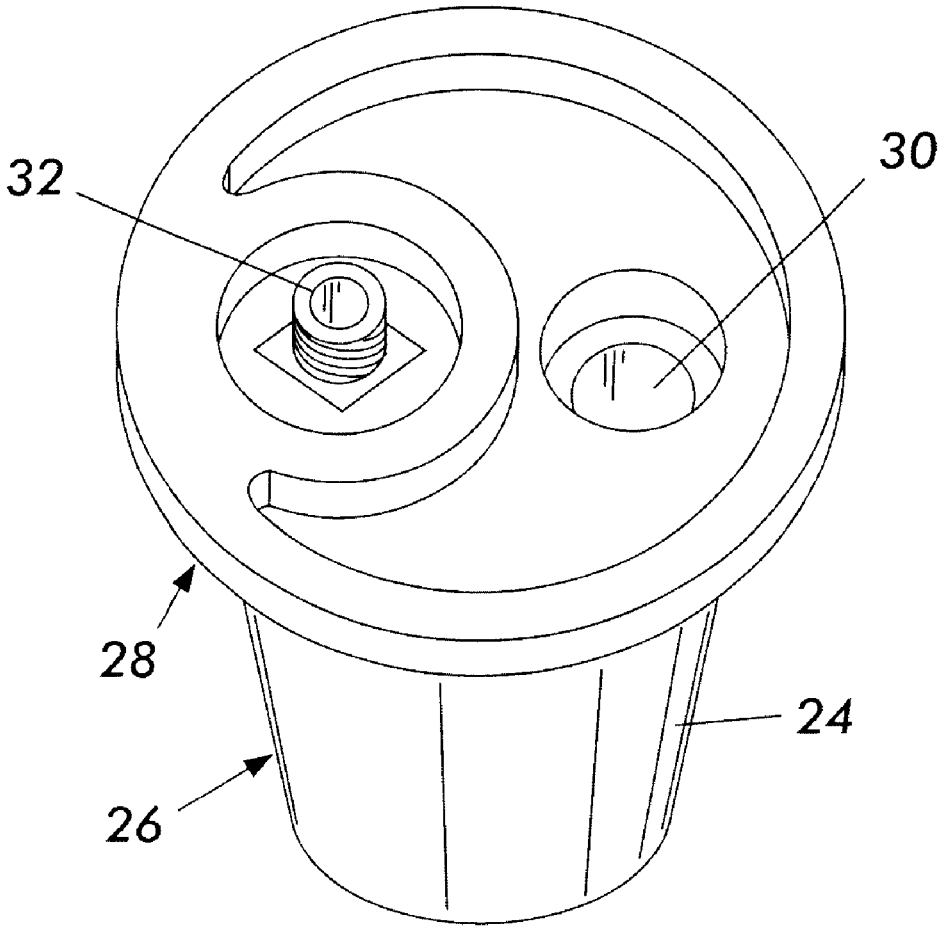
FIG. 2 is a perspective view of the compliant base of FIG. 1.

Referring to FIGS. 1 and 2, there is depicted an embodiment of the present invention. More specifically, the liquid handling apparatus 20 includes a compliant base element 24 that has at least one tapered side 26. It will be appreciated that the shape of base element 24 may be generally conical, with one or more shoulders 28. The taper of the walls, combined with the compliant material of the base element, preferably made of made of a conformable material (e.g., rubber or polymer such as Santoprene 101-64, or a thermoplastic elastomer such as Vyram®) having a durometer in the range of 50–75 on a Shore A scale. The tapered outer sides 26 and the compliant material enable the base element to be sealingly inserted within tanks having various diameter openings such as $D_1$, $D_2$ and $D_3$ illustrated in FIG. 1. It will be further appreciated that the outer perimeter of the base element may include further shapes, protrusions, etc. so as to enable the base to adapt and seal to any of a plurality of container and fuel tank openings so as to allow the pump 52 to negatively pressurize the container or tank.

Compliant base element 24, including the various orifices and through-holes and passageways characterized herein, may also be produced in a cored form, where the material required to manufacture the base element is significantly reduced through the use of bridging members (not shown). The use of such a design not only reduces the amount of material required to make the base element, it further contributes to the compliant nature of the base element so as to allow it to easily adapt to various opening diameters and to slightly misshapen openings to achieve a generally air-tight seal thereto.

Figure 3:
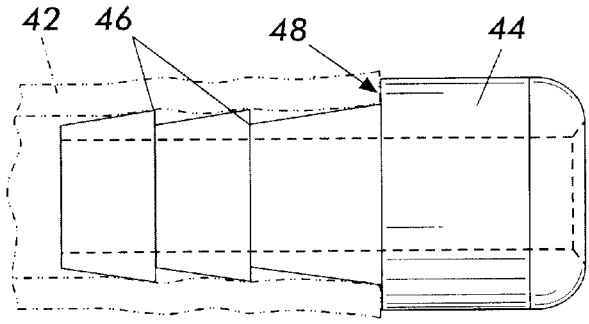
FIG. 3 is an enlarged view of the end of the tubing used in accordance with an aspect of the present invention.

Extending through compliant base element 24 is a first hole 30, suitable for receiving a first end 40 of a length of tubing 42. It will be appreciated that the length of said tubing 42 may be variable, but should be of sufficient length (at least 4 feet) so as to enable access to a liquid reservoir or fuel tank. It will also be appreciated that tubing 42 may be comprised of several sections of tubing attached together, where the diameter of the tubing sections is different—so as to allow smaller tubing diameter to be used for reaching into small reservoir openings. As illustrated in FIG. 3, the opposite end of the tubing 42 may include a weighted fitting 44 therein so as to improve the ease with which it may be fed into a reservoir or fuel tank. Fitting 44 is preferably of a design as described in co-pending U.S. patent application Ser. No. 09/827,553, now abandoned, filed Apr. 6, 2001 by Cromwell et al. and previously incorporated by reference.

Referring briefly to FIG. 3, fitting 44 includes a series of raised ridges 46 that, when inserted into the inner diameter of tube 42, serve to frictionally retain the fitting within the tube. Inserted up to shoulder 48, the fitting acts as a weight and, along with the rounded or tapered profile of the exposed fitting end, improves the ease with which siphon tube 42 may be inserted into a vehicle gasoline tank. Fitting 44 is preferably cast or machined from a non-sparking metal alloy that is not affected by exposure to the liquid being siphoned/pumped by the present invention, such as a copper-based alloy of brass or bronze.

Figure 4:
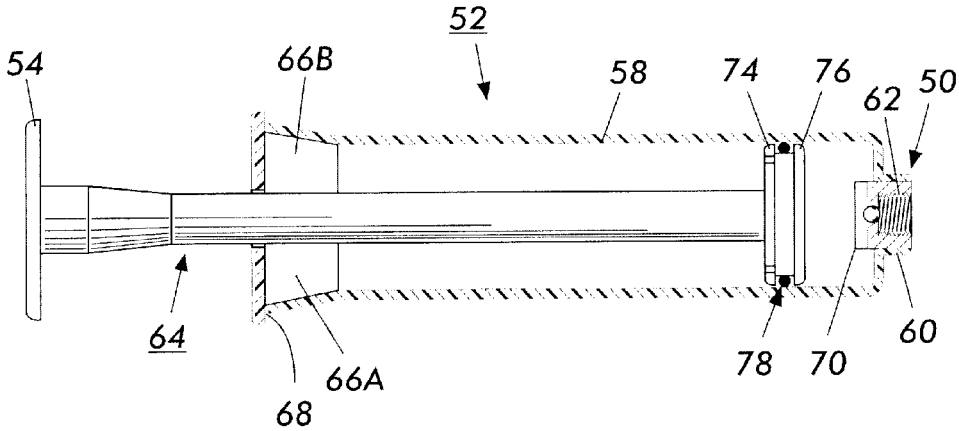
FIG. 4 is an enlarged view of the pump of FIG. 1.

Returning to FIGS. 1 and 2, compliant base element 24 also includes a second through-hole 32 suitable for receiving at least a nozzle end 50 of a vacuum pump 52. Preferably the vacuum pump is of a design similar to that described in co-pending U.S. patent application Ser. No. 09/827,553, now abandoned, filed Apr. 6, 2001 by Cromwell et al. and previously incorporated by reference. The pump is preferably of a design manufactured by Peaklie Co., Ltd. 2Fl, No. 115, Chung An St., San Chung City, Taipei Hsien, Taiwan, R.O.C. and referred to by Part No. CH004V, where the V stands for "vacuum-type" and the configuration of the pump has been changed pursuant to the present invention to enable it to create a vacuum rather than to create pressurized air exiting from the nozzle. Details of a similar pump design are found in U.S. Pat. No. 5,476,372 to Yang, issued Dec. 19, 1995, and hereby incorporated by reference for its teachings. Pumping the pump 52, by drawing upward on handle 54, causes a negative pressure to build within the lower end of the pump cylinder 58, and to be transferred, via a nozzle or aperture 60 and connected passageway or through-hole 32, to an associated portable or equipment tank or container (not shown). As depicted in FIGS. 2 and 4, the upper end of the through hole 32, in base 24, includes a threaded male fitting 36 that is preferably integrally molded into the compliant base. Fitting 36 is intended to be threadably attached to nozzle 62 as will be described below. Fitting 36 includes a hole therethrough that allows the interior of the pump 52 to be in communication with the through-hole 32 via the pump nozzle and fitting. Moreover, by attaching the pump 52 to the fitting, an airtight seal may be achieved to enable the vacuum created by pump 52 to be transferred to the through-hole 32.

As illustrated in more detail in FIG. 4, pump 52 includes a cylinder 58 ending in a threaded (female) nozzle 62 through a first end thereof and an opening through a second end. The second end is preferably sealed around a plunger 64 by an annular limit plate 66 comprised of two semi-circular halves 66A and 66B that extends a distance slightly larger than the outside diameter of the cylinder in order to create a shoulder 68. Plunger 64 further includes a piston 72 formed at an end of the plunger opposite the handle, the piston comprising first (74) and second (76) disks spaced from each other and a plurality of holes defined through the first disk 74.

In one configuration, pump 52 has a cylinder length of slightly longer than three inches and an inside diameter of approximately one inch. The displacement of such a pump is approximately 2.35 cubic inches of air per stroke of the plunger. While a pump of such a size is suitable for initiating a siphoning operation or pumping of low viscosity fluids, it will be appreciated that an improved pumping operation may be facilitated with a longer pump stroke and/or larger diameter cylinder. Hence, the specified pump is considered a minimum size, and pumps with longer cylinder lengths, for example approaching six inches, are contemplated for use in the present invention.

Pump 32 also includes a check valve 70 (preferably a ball-type valve with a seat—in a configuration opposite that depicted by Yang) in communication with the nozzle 60, said check valve allowing the ingress of air through the nozzle when the plunger is pulled upward by the user and substantially preventing the egress of air from the nozzle when the plunger is pushed downward by the user. Alternatively, the check valve may be a flexible elastomeric disk that is positioned at the end of the cylinder near the nozzle (not shown) as is well-known in various pumping apparatus. Piston 64 also includes a sealing device mounted between the first and second disks at the end of the piston.

The sealing device, an O-ring 78 (perhaps with a light coating of lubricant applied thereto), is moved back and forth between a position in contact with the first disk 74 and the second disk 76. When in contact with the first disk, air is allowed to flow through the holes in the first disk and the piston may be pushed downward (toward end 50) without resistance. When the sealing device is in contact with the second disk, a sealing of the piston to the wall of cylinder is accomplished and upon extracting the plunger a vacuum is created within the lower end of the cylinder 58—and therefore within the through-hole 32 and the tank 112 (FIG. 6) into which the pump is inserted. As noted above, the O-ring 78 may include a light coating of lubricant, to enable it to slide against the inner wall of cylinder 58 while maintaining a seal therewith. It is further contemplated that the type of lubricant employed may be a function of the nature of the liquid to be handled by the apparatus, or fumes that might be given off by the liquid. For example, it may be preferable to use a non-petroleum based lubricant for applications where the pump will be exposed to gasoline or other petroleum-based fuels.

Alternatively, in place or in conjunction with the O-ring 78, pump 32 may include a flexible disk or flapper associated with a surface of the first disk, so as to allow the passage of air through at least one of said plurality of holes when the plunger is pushed downward by the user and substantially preventing the egress of air through the disk when the plunger is pulled upward by the user. Such a configuration is also well-known in inflation pumps associated with sporting equipment.

Figure 5:
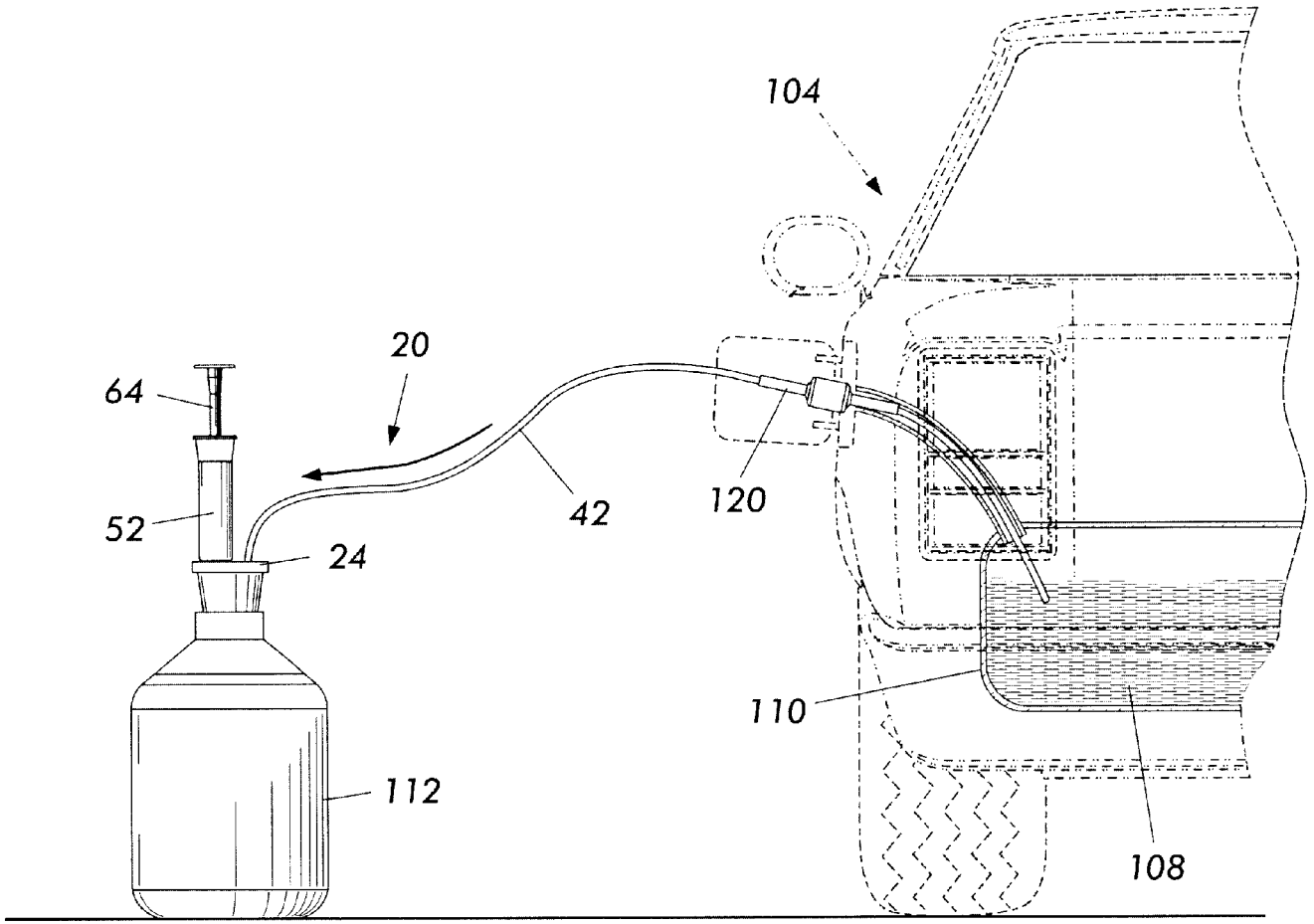
FIG. 5 is a general view illustrating one manner in which the liquid handling apparatus may be used for the transfer of liquid in accordance with an aspect of the invention.

Referring next to FIG. 5, the present invention is a liquid handling apparatus 20 designed to facilitate the transfer of fluid or fuel 108, from a first enclosed reservoir such as an automobile fuel tank 110 to a second container 112, which may be an equipment tank from which the liquid will be used directly by a piece of equipment (not shown) or a portable tank in which the liquid will be temporarily stored such as a gasoline container. Apparatus 20 includes a compliant base element 24, preferably having a tapered outer diameter to provide a generally airtight seal with the inner diameter of an opening on tank 112. Upon insertion of the end of the length of tubing 42 into the liquid-filled reservoir 110, and insertion into and sealing of the compliant base with the tank 112, the pump 52 may be operated by pumping handle 54 to negatively pressurize the tank and initiate the flow of liquid from reservoir 110 to the tank 112.

Figure 6:
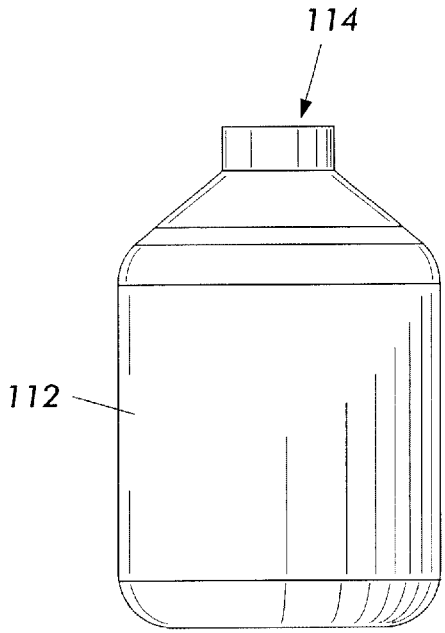
FIG. 6 depicts a container such as shown in FIG. 5.

Referring next to FIG. 6, depicted therein is an exemplary tank for use with the liquid handling apparatus 20 of the present invention. In particular, tank 112 is preferably formed with an opening 114 of approximately 1.800 inches in diameter. Tank 112 is designed to hold approximately 48 ounces of liquid, and is preferably manufactured from a material resistant to certain liquids and breakage; for example, a high-density polyethylene (HDPE) of similar material having a wall thickness of approximately 0.080 inches.

Figure 7:
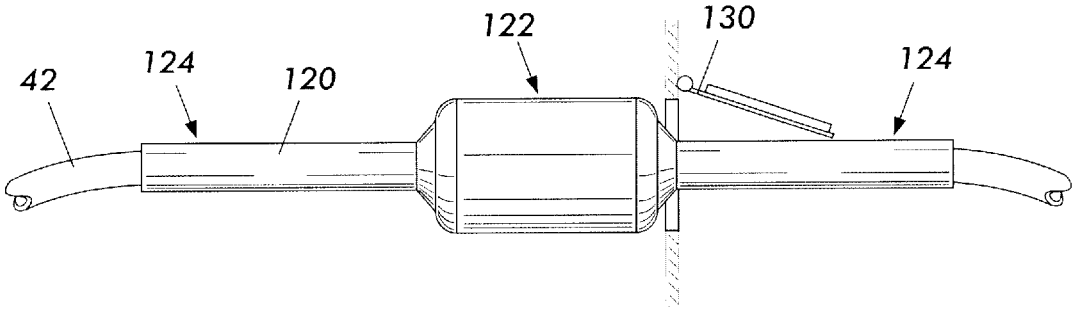
FIG. 7 is a detailed illustration of the flap diverter shown in FIG. 5.

FIG. 7 illustrates a detailed depiction of a flap diverter 120 that may be employed in accordance with an alternative embodiment of the present invention. IN particular, referring to FIG. 5, when a user wishes to insert tube 42 into the automobile's gas tank, the user will receive resistance to the insertion of the tubing by a spring-loaded flap 130. Flap 130 is designed to prevent the escape of gasoline fumes from the vehicle tank. However, flap 130 can also be a nuisance when a used is attempting to insert tube 42 into the vehicle tank 110. According, by first inserting the flap diverter into the opening, and then inserting the tube 42 through the hollow center of diverter 120, it will be easier for the user to insert the tubing 42 all of the way to the fuel level in tank 110. In the embodiment depicted, diverter 120 includes a central, large diameter region 122 between smaller diameter regions 124 on either end. The intention of the design is that the narrower diameter regions may be inserted within the fuel-filling hole of a standard vehicle tank, whereas the larger-diameter region 122 will prevent a user from inadvertently inserting the flap diverter entirely into the fuel fill hole. While various diameters may be employed, the intent is to provide a semi-rigid diverter, preferably molded from HDPE, where the inner diameter of the diverter is sufficient to assure that tubing 42 will easily slide therethrough. Accordingly, the outer diameter of the smaller regions is approximately 0.75 inches and the wall thickness is on the order of 0.10 inches.

It is further contemplated that the location of tank 112 may be at a height above the level of the fluid in reservoir 110, such that the transfer of liquid to the tank is only accomplished by the continued operation of vacuum pump 52. Such a situation is represented by a situation where a user may seek to remove fuel, engine oil, or water from a boat, where the container to receive the fluid of located on a dock or pier at a level above that of the boat.

Having described the various components of a liquid handling apparatus in accordance with the present invention, it will also be appreciated that the apparatus may be employed in a method of extracting liquid from a reservoir with the liquid handling apparatus as depicted in FIG. 5. In particular, the process generally includes the steps of: inserting the compliant base 24, having a tapered outer profile and a pair of through-holes therein, into an opening of a container 112 suitable for receiving a liquid; followed by inserting, into a first of said through-holes, a first end of a length of tubing so as to form an air-tight connection between the first end of the tubing and the compliant base. Having established a connection between the compliant base, the container and the tubing, the second end of the length of tubing may be inserted into the liquid-filled reservoir (gas tank 110 of car 104) so that the second end is below a surface of the liquid 108. Once completed, a negative pressure or vacuum is applied to the second through hole in the compliant base 24, preferably by attaching a vacuum pump 52 to the second through-hole in an airtight manner, the pump having a handle for driving a plunger therein and being suitable for producing a vacuum within the container when the compliant base is inserted in the opening of the container and the handle is operated by a user. Hence, repeatedly operating the handle on the vacuum pump will create a vacuum in the container and draw the liquid from the liquid-filled reservoir into the container to initiate transfer of the liquid from the reservoir to the container.

In recapitulation, the present invention is an apparatus for the transfer of fluid or fuel, from a first enclosed reservoir to a second container, which may be a tank from which the liquid will be used or a tank in which the liquid will be temporarily stored. The apparatus includes a compliant base element, preferably having a tapered outer diameter and two holes therethrough. The first hole is adapted to sealingly receive one end of a length of tubing whereas the second hole is adapted to be sealingly receiving the intake end of a vacuum pump. Upon insertion of the opposite end of the length of tubing into a liquid-filled reservoir, and insertion into and sealing of the compliant base with a container or tank, the pump may be operated to negatively pressurize the tank or container an initiate the flow of liquid from the reservoir to the tank or container.

It is, therefore, apparent that there has been provided, in accordance with the present invention, an apparatus for safely transferring a fluid such as fuel, from a first reservoir to a second container or tank. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A liquid handling apparatus, comprising:

a compliant base having a tapered outer diameter suitable for mating with an inner diameter of a container opening so as to form a generally airtight seal therewith, said compliant base further including a pair of through-holes, wherein a first through-hole is itself tapered, with its larger inner diameter at a top of the compliant base, such that the taper facilitates a user's insertion of a length of fluid intake tubing having a first end inserted through the first through-holes in said compliant base, so as to form an air-tight connection at a lower end of the through-hole between the fluid intake tubing and the base; and a vacuum pump, said vacuum pump being releasably inserted into an upper end of a second one of said through-holes in an airtight manner, the pump being suitable for producing a negative pressure within the container the pump is operated by a user;

wherein a second end of the fluid intake tubing is inserted into a liquid reservoir and where operation of the pump by the user creates a negative pressure sufficient to draw the liquid from a liquid reservoir into the container.

2. The apparatus of claim 1, wherein the first end of the fluid intake tubing extends through said compliant base and into the container.

3. The apparatus of claim 1, wherein said vacuum pump is a manual pump, comprising:

a cylinder defining a nozzle through a first end and having an opening through a second end;

a plunger comprising a stem and a piston formed at an end of the stem;

a check valve in communication with the nozzle, said check valve allowing the ingress of air through the nozzle when the plunger is pulled upward by the user and substantially preventing the egress of air from the nozzle when the plunger is pushed downward by the user;

a sealing device associated with the piston, said sealing device allowing air to pass through the piston when the plunger is pushed downward by the user, and substantially preventing the passage of air through the piston when the plunger is pulled upward by the user; and a handle formed at an opposite end of the stem.

4. The apparatus of claim 3, wherein the cylinder is of a length suitable to provide a piston stroke length of at least three inches.

5. The apparatus of claim 4, wherein the piston comprises first and second disks spaced from each other and a plurality of holes defined through the first disk thereof, and where the sealing device is an a-ring mounted between the first and second disks of the piston so as to allow the passage of air through at least one of said plurality of holes defined through the first disk when the plunger is pushed downward by the user and substantially preventing the egress of air past the a-ring and second disk when the plunger is pulled upward by the user, thereby creating a vacuum in a lower portion of the cylinder, said vacuum being transferred to the container via the nozzle.

6. The apparatus of claim 3, where said base further includes a first threaded fitting attached to the upper end of the second through-hole, and where said vacuum pump further includes a second threaded fitting in the nozzle, wherein said vacuum pump is releasably attached to said base by operatively connecting said first threaded fitting to said second threaded fitting.

7. The apparatus of claim 6, wherein said base further includes a recess in which the first threaded fitting is located so as to provide compliant base material that contacts the nozzle end of said vacuum pump to assure an airtight seal therewith.

8. The apparatus of claim 1, wherein the second end of the length of fluid intake tubing further comprises a weighted fitting inserted therein, and where the fitting has a rounded profile on an outer end thereof.

9. The apparatus of claim 1, wherein said compliant base is manufactured from a thermoplastic elastomer.

10. The apparatus of claim 9, wherein the thermoplastic elastomer is Vyram®.

11. The apparatus of claim 1, wherein the reservoir is a fuel tank in a vehicle and where the fuel tank has a spring-loaded flap therein to control the evaporation of fuel from the fuel tank, further comprising a flap diverter for holding the spring-loaded flap in an open position while the second end of the fluid intake tubing is inserted therethrough and into the fuel tank.

12. The apparatus of claim 1, wherein the compliant base includes a shoulder extending outwardly therefrom along at least a portion of a perimeter of the top of the complaint base.

13. A liquid handling apparatus, comprising in series:

a length of fluid intake tubing having a first end and a second end;

a compliant base having a tapered outer profile suitable for sealingly mating with a plurality of containers having different diameter openings therein, wherein the first end of the fluid intake tubing is attached to a first, tapered opening in said compliant base, so as to form an air-tight connection between the first end of the fluid intake tubing and the compliant base; and a vacuum pump operatively attached to a second opening in said compliant base in an airtight manner, the pump having a handle driving a plunger therein and being suitable for producing a vacuum within one of the plurality of containers when the handle is operated by a user;

wherein the second end of the fluid intake tubing is inserted into a liquid reservoir having a liquid therein and where the vacuum draws the liquid from the liquid reservoir and into the one of the plurality of containers to initiate transfer of the liquid.

14. The apparatus of claim 13, wherein said vacuum pump further comprises:

a cylinder defining a nozzle through a first end and having an opening through a second end;

the plunger including a stem and a piston formed at an end of the stem opposite the handle;

a check valve in communication with the nozzle, said check valve allowing the ingress of air through the nozzle when the plunger is pulled upward by the user and substantially preventing the egress of air from the nozzle when the plunger is pushed downward by the user; and a sealing device associated with the piston, said sealing device allowing air to pass through the piston when the plunger is pushed downward by the user, and substantially preventing the passage of air through the piston when the plunger is pulled upward by the user.

15. The apparatus of claim 14, wherein the piston comprises first and second disks spaced from each other and a plurality of holes defined through the first disk thereof, and where the sealing device is an a-ring mounted between the first and second disks of the piston so as to allow the passage of air through at least one of said plurality of holes defined through the first disk when the plunger is pushed downward by the user and substantially preventing the egress of air past the a-ring and second disk when the plunger is pulled upward by the user, thereby creating a vacuum in a lower portion of the cylinder, said vacuum being transferred to the one of the plurality of containers via the nozzle.

16. The apparatus of claim 14, where said base further includes a first threaded fitting attached to the second opening, and where said vacuum pump further includes a second threaded fitting in the nozzle, wherein said vacuum pump is releasably attached to said base by operatively connecting said first threaded fitting to said second threaded fitting.

17. The apparatus of claim 13, wherein the liquid reservoir is a fuel tank in a vehicle and where the fuel tank has a spring-loaded flap therein to control the evaporation of fuel from the fuel tank, further comprising a flap diverter for holding the spring-loaded flap in an open position while the second end of the fluid intake tubing is inserted therethrough and into the fuel tank.

18. The apparatus of claim 17, wherein the second end of the length of fluid intake tubing further comprises a weighted fitting inserted therein, and where the fitting has a rounded profile on an outer end thereof.

19. A method of extracting liquid from a reservoir with a liquid handling apparatus, comprising the steps of:

inserting a compliant base, having a tapered outer profile and a pair of through-holes therein, into an opening of a container:

inserting, into a first of said through-holes, a first end of a length of tubing so as to form an air-tight connection between the first end of the tubing and the compliant base;

inserting a second end of the length of tubing into a liquid-filled reservoir so that the second end is below a surface of the liquid;

attaching a vacuum pump to the second through-hole in the compliant base in an airtight manner, the pump having a handle driving a plunger therein and being suitable for producing a vacuum within the container when the compliant base is inserted in the opening of the container and the handle is operated by a user; and repeatedly operating the handle on the vacuum pump to create a vacuum in the container and draw the liquid from the liquid-filled reservoir into the container to initiate transfer of the liquid from the reservoir to the container.

* * * * *